US005315946A

United States Patent [19]

Howell et al.

[11] Patent Number: 5,315,946

[45] Date of Patent: May 31, 1994

[54] METHOD AND APPARATUS FOR AUTOMATICALLY ATTACHING A COLLARETTE, DISPLAY AND LABEL TO A GARMENT BODY

[75] Inventors: David C. Howell, Clemmons; John C. McEwen, Mocksville, both of N.C.

[73] Assignee: Sara Lee Corporation, Chicago, Ill.

[21] Appl. No.: 711,659

[22] Filed: Jun. 6, 1991

[51] Int. Cl.[5] ..... D05B 35/06; D05B 19/00

[52] U.S. Cl. ..... 112/265.1; 112/121.27; 112/121.11; 112/113; 112/152

[58] Field of Search ..... 112/265.1, 104, 113, 112/121.27, 152, 121.11, 130

[56] References Cited

U.S. PATENT DOCUMENTS

| | | | |
|---|---|---|---|
| 3,664,284 | 5/1972 | Hester | 112/152 |
| 3,750,603 | 8/1973 | Martin | 112/121.11 X |
| 4,432,294 | 2/1984 | Price et al. | 112/152 X |
| 4,611,546 | 9/1986 | Miyakawa | 112/121.27 |
| 5,040,472 | 8/1991 | Schips | 112/113 X |

*Primary Examiner*—Peter Nerbun

*Attorney, Agent, or Firm*—Morgan & Finnegan

[57] ABSTRACT

A method and apparatus for attaching a collarette, display, and label incorporating the use of a sewing machine having a sewing head, a collarette feed means, a display feeder, a label feeder, leading and trailing edge detectors, a stitch counter, and a controller to control each device and perform necessary calculations is disclosed.

14 Claims, 6 Drawing Sheets

METHOD AND APPARATUS FOR AUTOMATICALLY ATTACHING A COLLARETTE, DISPLAY AND LABEL TO A GARMENT BODY

BACKGROUND OF THE INVENTION

1. Field of the Invention

The present invention relates to a method and apparatus for automatically attaching a collarette, display and label to a garment body by synchronizing sewing and material feeding.

2. Description of the Prior Art

Garments such as shirts or blouses are typically manufactured using manual labor. Garment pieces are cut out of stock material, trimmed to proper dimensions, and then sewn together on a sewing machine by a sewing machine operator.

Often in garment manufacturing, a piece of material, known in the art as a "collarette", is folded and sewn around the garment neck to form a continuous collar. The conventional method of sewing a collarette to a garment neck is performed by a sewing machine operator in the following manner. First, the collarette is cut to a size slightly shorter than the garment neck edge where the collarette is to be sewn. Then, the operator positions the collarette on top of the garment body, places the material under a sewing machine and starts sewing. While sewing, the operator must continually maintain the alignment of the collarette and garment body to obtain an evenly manufactured finished product. Additionally, the operator must pull and stretch the collarette during the sewing operation. Stretching the collarette in such a manner will cause the completed garment and collarette to lie flat and have no wrinkles or gathers around the neck when worn.

The operator may also be required to attach a label (e.g. a manufacturer's identifier having the manufacturer's name and product information) to the garment with the same stitch being used to attach the collarette to the garment. To perform this operation, the operator must carefully position and hold the label in the desired location while sewing.

Additionally, the operator may be required to sew a small strip of material, known in the art as a "display", to the inside of the garment neck to flatten and cover the seam joining the collarette and label to the garment body (the "joining seam"). The display is used to cover the area inside the garment where the joining seam would be partially visible after the garment is packaged for sale, i.e., on the inside back portion of the garment neck. To sew a display to a garment the operator must carefully position and hold the display on top of the collarette and garment body while sewing.

Further complications to the above-described conventional sewing operation are encountered when the joining seam is to be hidden from view from the outside of the garment (i.e. the side of the garment away from the body of the wearer). To hide the joining seam, an operator must layer the collarette, display, and label on top of the garment body and use an "overedge stitch" to join the pieces together. The resulting "overedge seam" is then hidden from the outside of the finished garment. To sew a collarette, label, and display to a garment body with an overedge stitch an operator must first manually arrange and layer the materials one on top of the other as follows: garment body, collarette, display, and label. The operator then passes the layered materials through the sewing machine, maintaining them in constant alignment while stretching the collarette as described above. If desired, a second sewing operation is then performed to attach the loose edge of the display to the garment body with a top stitch to assure that the display covers the overedge seam and a portion of the label.

The manual process of sewing a collarette, display, and label to a garment body is difficult and tedious. The quality of the finished product is often variable and is largely dependent on the experience and skill of the sewing machine operator Moreover, the conventional process is time consuming due to the need to precisely arrange and sew the materials together.

It is therefore an object of the present invention to provide a new method and apparatus for automatically attaching a collarette and other materials to a garment body.

Another object of the present invention is to provide a new method and apparatus capable of attaching a collarette, display, and label to a garment body in an efficient and precise manner without the need of manual assistance to feed and maintain alignment of the materials during the sewing operation.

It is a still a further object of the present invention to provide a new and improved method and apparatus capable of attaching a collarette, display, and label to a garment body such that the resulting product is of a consistently high quality, but manufactured using less time and manpower.

SUMMARY OF THE INVENTION

The above-described and other objects of the invention are met by providing an apparatus for attaching a collarette, display, and label preferably incorporating a sewing machine having a sewing head, a collarette feed means, a display feed means, a label feed means, a leading and trailing edge detector means, a stitch count means, and a controller means to control each device and perform necessary calculations.

In a preferred embodiment, an operator places garment body on the sewing machine where the leading edge detector means detects the presence of the garment body and signals the controller means to commence sewing. As the garment is being fed through the sewing machine, the collarette material is stretched and automatically fed and sewn to the garment body by the collarette feed means and sewing head. Once sewing commences, the controller means in combination with the stitch counting means counts the total number of stitches sewn. When the total stitch count equals a first predetermined stitch count, the controller means commands the display feed means to move to the sewing area and begin feeding the display material to the sewing head. When the total stitch count equals a second predetermined stitch count, the controller means commands the label feed means to automatically feed a label to the sewing area. When the total stitch count equals a third predetermined stitch count, the controller means commands the display feed means to move away from the sewing area to terminate the sewing of the display material. Finally, when the trailing edge detector means detects the end of the garment body, the sewing machine stops sewing.

By using predetermined stitch counts for the display and label feeding and maintaining a total stitch count during the sewing operation, the present invention is able to synchronize the commencement and termination of mechanical feeding of the display and label to achieve a consistently even manufactured product in less time using less manpower.

BRIEF DESCRIPTION OF THE DRAWINGS

The invention will be described in greater detail below by use of reference to the accompanying drawings, wherein.

DETAILED DESCRIPTION OF THE PREFERRED EMBODIMENTS

Figure 1:
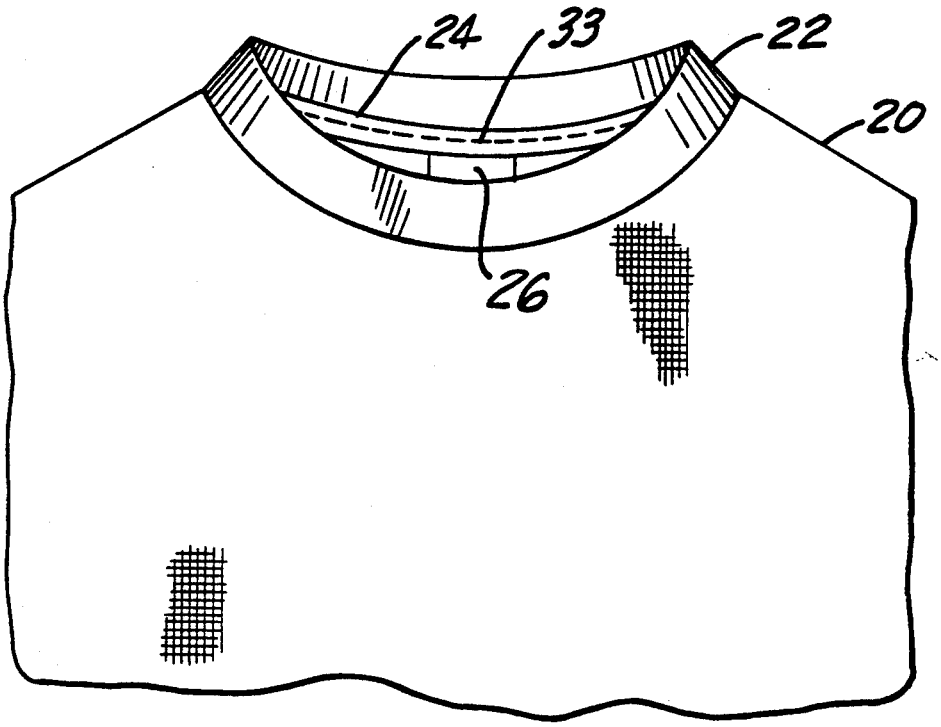
FIG. 1 is of a completed garment having a collarette, display, and label.

Referring to the drawings, FIG. 1 shows the components of a completed garment having a collarette 22, display 24 and label 26 which are fashioned from known materials used for shirts, blouses, or the like. The sizes and dimensions of the various pieces are based on the desired sizes and dimensions of the finished product. For example, in an average T-shirt, the width of collarette 22 is typically in the range of 1 3/16" to 1 7/16" and the width of display 24 is typically 7/16" to ½" wide. As will become readily apparent to those skilled in the art, the widths of the collarette and display can be easily varied.

Label 26, which provides the purchaser or wearer with information concerning the garment (e.g., size, manufacturer, washing instructions), may be made from various known materials such as nylon, cloth, or the like. The size of label 26 is usually dependent on the amount and the size of the writing present.

As shown in FIG. 1, display 24 and label 26 are affixed in a position such that display 24 covers the overedge seam (not shown) which would be visible along the inside the garment neck when the garment is placed on its back. Also shown is top stitch 33 used in a second sewing operation to sew the base end of the display over the overedge seam.

Figure 2:
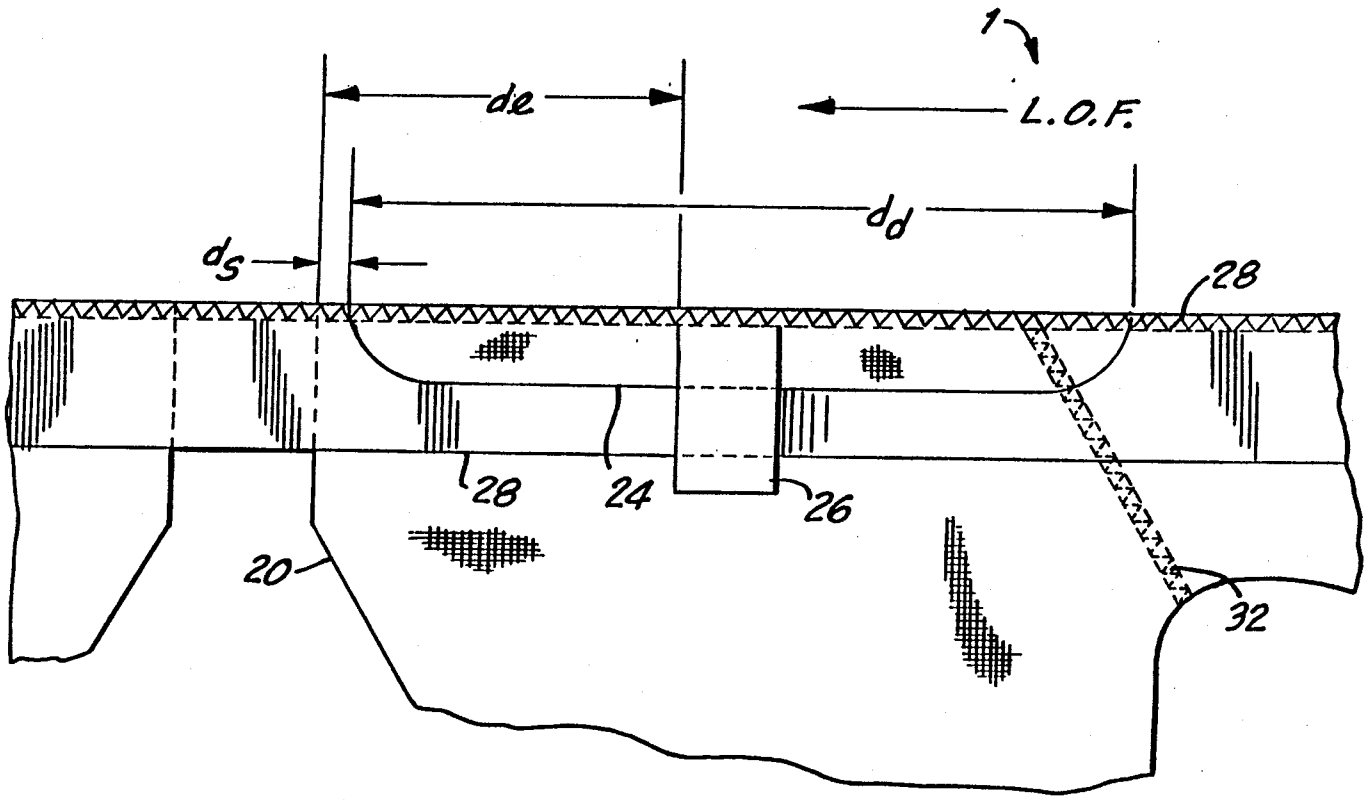
FIG. 2 is a planar view of the layered arrangement of garment body, collarette, display and label as they are sewn together using an overedge stitch.

FIG. 2 is a planar view illustration of the layering of garment body 20, collarette 22, display 24, and label 26 as fed through the apparatus of the present invention. The layering allows the garment body, collarette, display, and label to be sewn together with a single overedge stitch. The overedge stitch, known in the art as a 540 SSa-1 stitch, forms an overedge seam 28. To assure proper placement of display 24, the display is preferably sized so as to overlap shoulder seam 32 by approximately ¾". As will become readily apparent to those skilled in the art, the overlap distance can be varied as desired. Line of feed ("L.O.F.") arrow 1 indicates the direction the garment body, collarette, display and label are fed through the sewing apparatus of the present invention.

Figure 3:
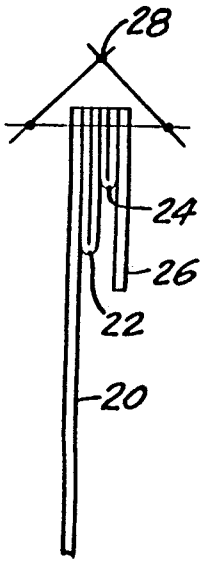
FIG. 3 is a side view of the layered arrangement of FIG. 2.

FIG. 3 is a side view illustration of the layering of FIG. 2 as fed through the sewing apparatus of the present invention.

Figure 4:
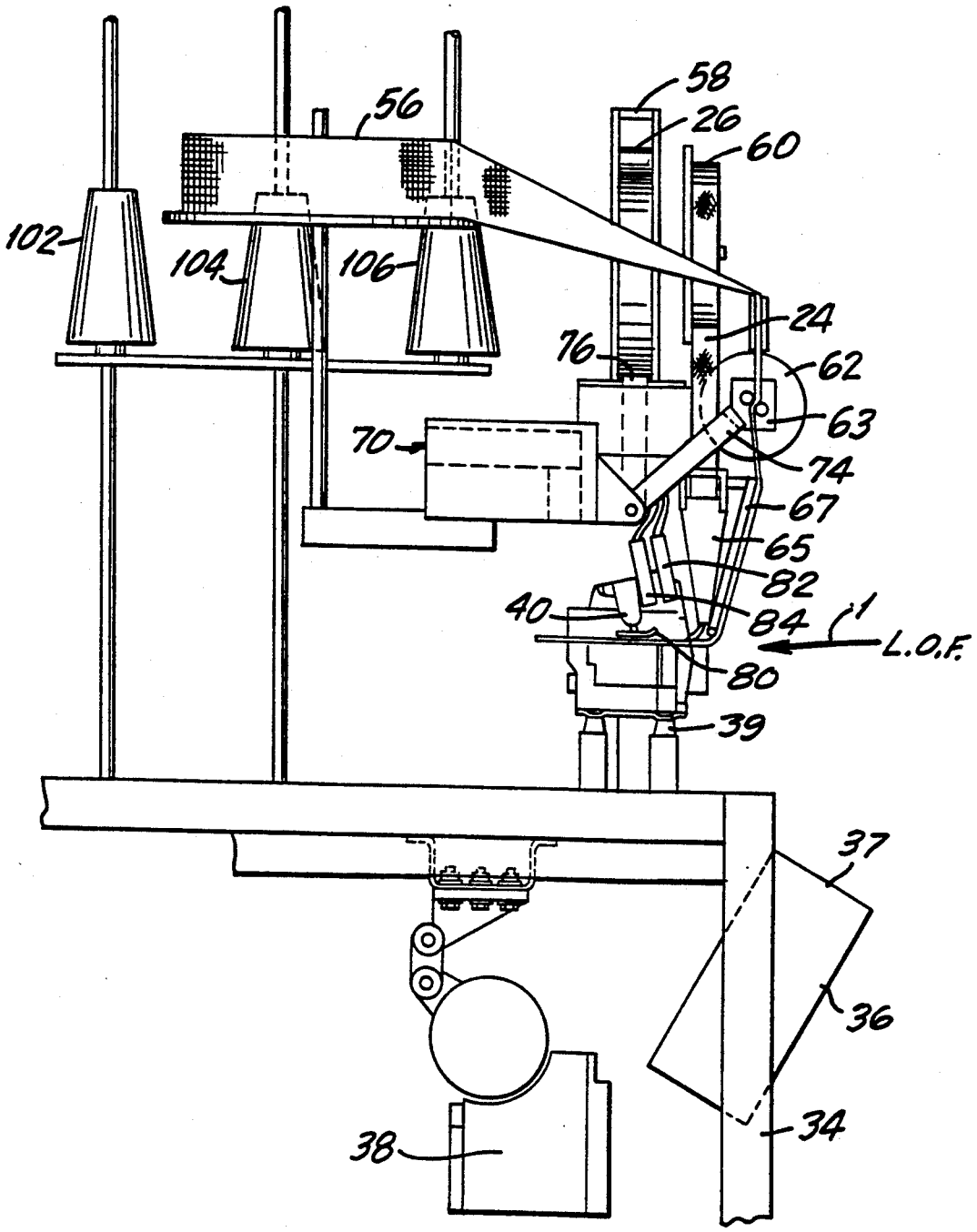
FIG. 4 is a left side view of an embodiment according to the present invention.
Figure 5:
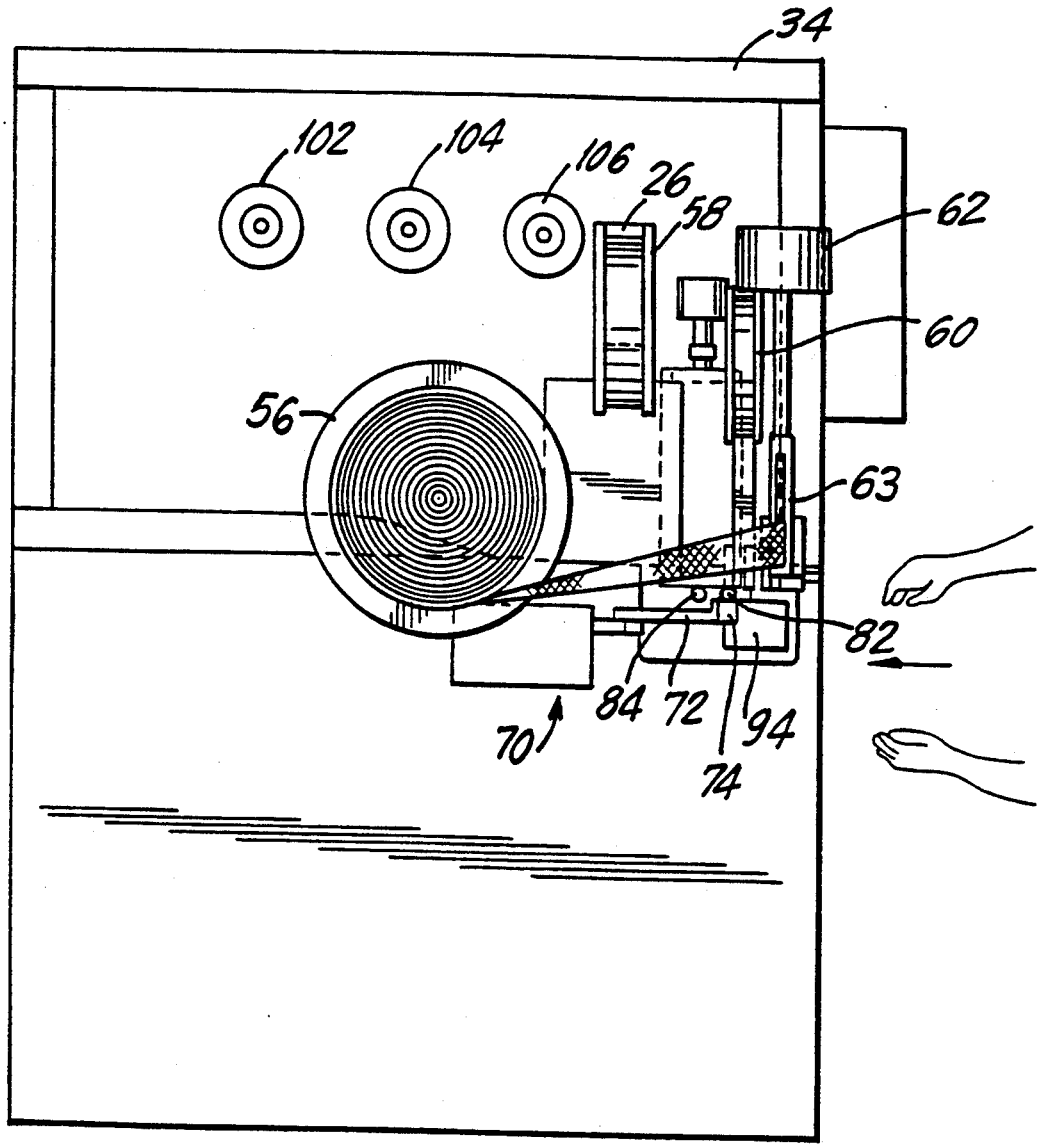
FIG. 5 is a top view of the embodiment of FIG. 4.
Figure 6:
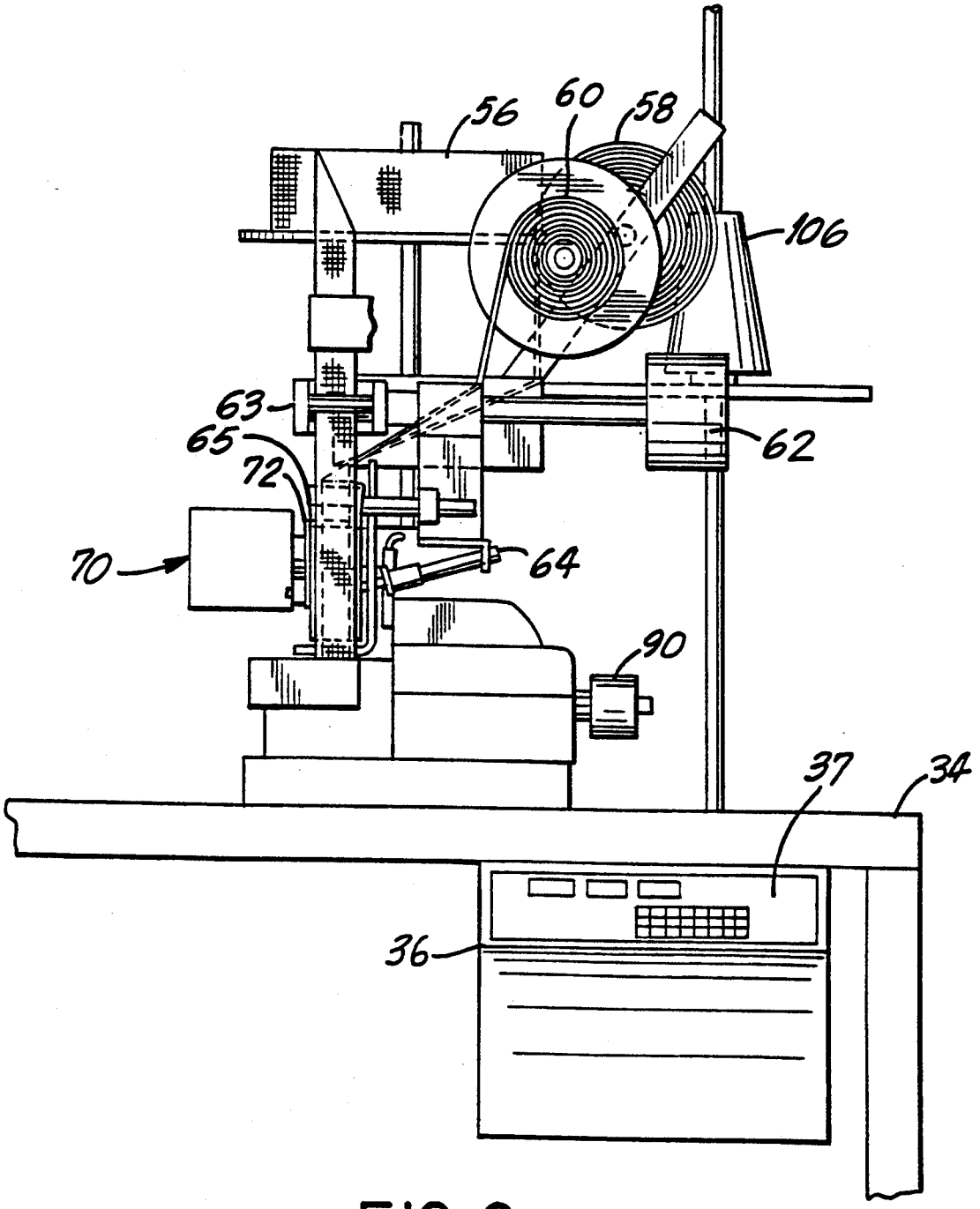
FIG. 6 is a front view of the embodiment of FIG. 4.

A preferred embodiment of the present invention is illustrated in the side, top, and front views of FIGS. 4, 5, and 6 respectively.

Frame 34 is used to support the various elements of the present invention. A controller 36 having a control panel 37 is attached to frame 34 as shown. In the preferred embodiment, a Model ASCS 202/3 controller manufactured by SAHL of Austria, is used as controller 36 and control panel 37. The control panel 37 is used to allow an operator to input to the controller certain predetermined garment parameters such as size. Motor 38 is used to drive a sewing machine 39 having a sewing head 40. In the preferred embodiment, a 39500 series sewing machine, manufactured by Union Special Corporation of Chicago, Ill., is used.

Rolls 56, 58 and 60 are used to provide a continuous supply of collarette 22, label 26, and display material 24 respectively. As will become readily apparent to those skilled in the art, the supply of these materials may be from flat continuous strips of folded material, commonly called festooning. The size and dimension of supply rolls 56, 58 and 60 are dependent on the materials used. Additionally, thread supply spools 102, 104 and 106 supply thread to sewing head 40 in a known manner.

Collarette feed motor 62 is used to drive collarette feed rollers 63 which maintain the collarette material in tension between the rollers 63 and the sewing head 40. The tension created effectively stretches the collarette material as it is being sewn to the garment body so that the completed garment and collarette will lie flat and have no wrinkles or gathers around the neck when worn.

Display feeder 65 is used to fold the display material and to guide same into the sewing area so as feed the display material 24 on top of the collarette material 22 and under presser foot 80 and sewing head 40. The resulting adhesion between the collarette 22 and the display 24 while under sewing head 40 causes the display material to unroll from display supply roll 60 and feed under the sewing head 40. Pneumatic display feed inserter 64 is used to move display feeder 65 into and out of the sewing area on command from the controller 36. Plate 67 is used to help guide the collarette material under the display feeder 65 and presser foot 80.

Label feeder 70 is used to cut labels from supply roll 56 and feed same to sewing head 40. In the preferred embodiment, a Model SES 170, GP Label Dispenser, manufactured by SAHL is used. The label feeder comprises a motor (not shown) to drive label arm 72, a pneumatic gripper 74 for gripping a label 26, and a hot wire knife 76 for cutting labels from label supply roll 58. On command from controller 36, the label arm 72 and gripper 74 grab a label 26 from the hot wire knife 76 and deliver same under presser foot 80 to sewing head 40.

Leading and trailing sensors 82 and 84, having light emitting diodes (LED's) and photodetectors, are used to detect the leading and trailing edge of a garment body 20. When no garment body is present, light from the LED's is reflected from reflective material patch 94 and detected by the photodetectors. The sensors then signal to controller 36 a "no garment" status signal. When a garment is placed in the sewing area, the light is no longer reflected and therefore not detected by the photodetectors. The sensors then signal to controller 36 a "garment present" status signal. Stitch counter 90 is used to count each revolution, which represents one stitch, of sewing head 40 and signals same to controller 36 which maintains a total stitch count for each sewing operation.

In the preferred embodiment, all motors, pneumatic devices, and sensors are digital devices. Nevertheless, as will become readily apparent to those skilled in the art, analog devices can be used.

Once a device is configured as described above, the sewing method of the present invention can performed as described below.

To begin, an operator feeds the collarette and display material through their respective feed mechanisms to effectively prime the apparatus for commencement of a sewing operation.

The operator then measures in inches the appropriate garment size parameters. Referring to FIG. 2, the operator measures the distance from the leading garment neck edge to the start of display ($d_s$), the distance from the leading garment neck edge to the start of label ($d_l$), and the length of display ($d_d$). The operator then converts the measurements to stitch counts ($n_x$) by using the following equation: $n_x = d_x \times s$, where s is the number of stitches per inch the sewing head 40 performs. In a preferred embodiment, s has the value of approximately 12 stitches per inch (s=12).

Figure 7:
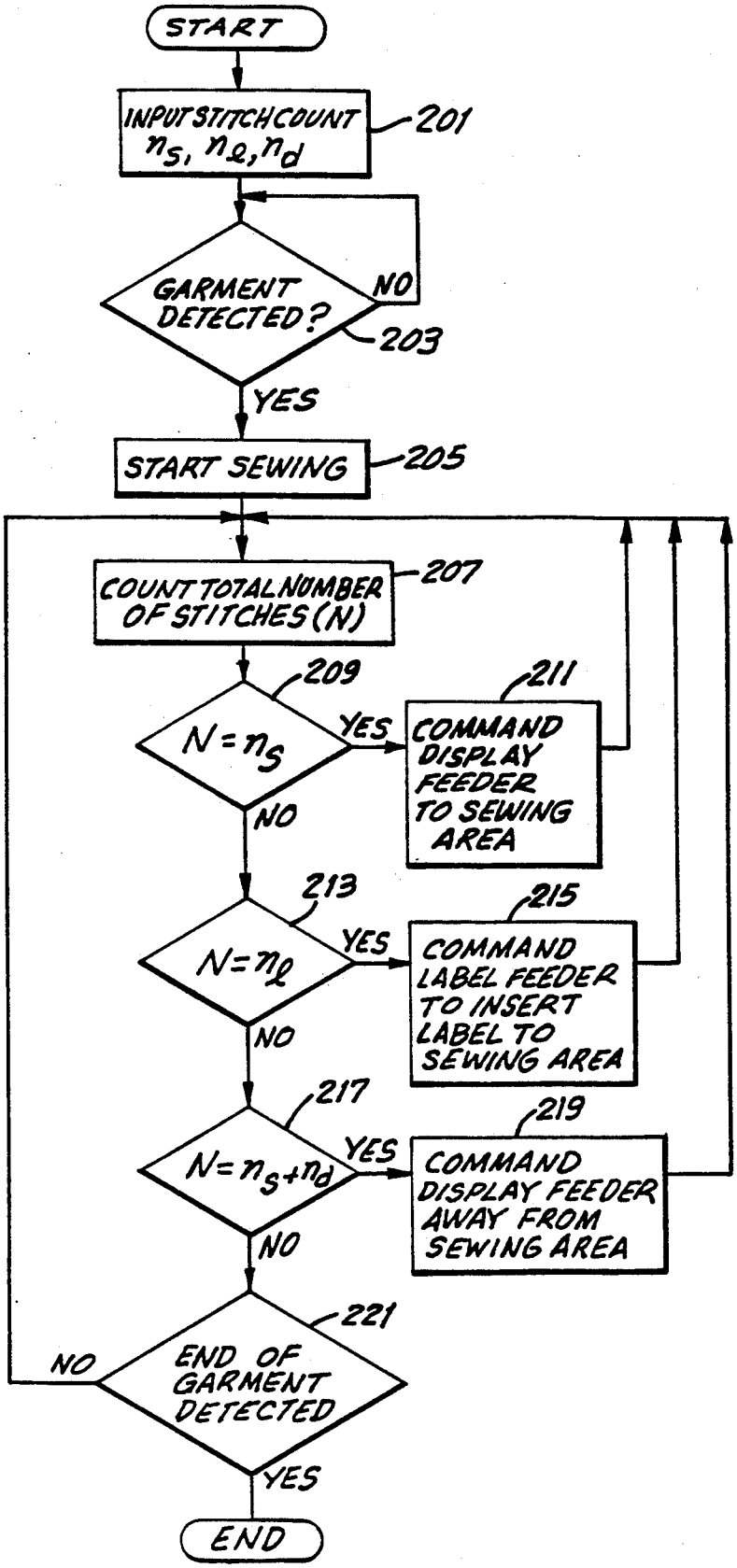
FIG. 7 is a flow chart of the operation of the present invention.

The operator then activates the controller via the control panel to start a sewing operation. Referring to the flow chart of FIG. 7, the controller executes the series of steps illustrated therein and described as follows. The controller begins at step 201 where the operator inputs via control panel 37 the number of stitches to be sewn before the start of the display ($n_s$) and label ($n_l$) and the number of stitches to be sewn for the display ($n_d$).

The controller then advances to step 203 where it waits for a garment to be detected, i.e. loaded on to the sewing machine 39. The operator then manually loads the garment body 20 until its edge is under presser foot 80. It will become apparent to those skilled in the art that the loading of the garment body may be accomplished by mechanical or automated mechanisms. As the garment body 20 and collarette 22 are maneuvered under presser foot 80, leading edge sensor 82 detects the presence of the garment and signals to the controller 36 that a garment is present as described above. The controller then advances to step 205 where the controller directs sewing head 40 to commence sewing the collarette 22 to the garment body 20. In the preferred embodiment, the sewing operation does not actually begin until the operator presses on a foot switch (not shown). The foot switch acts as a separate safety feature and control mechanism. Both the garment body and collarette are urged under presser foot 80 by forces generated by feed dogs (not shown) under the garment body material. The frictional interference between the collarette material 22 and the garment body 20 also assists in maintaining the position of the collarette and garment body under presser foot 80. Additionally, as described above, collarette feed rollers 63 maintain tension between the rollers 63 and the sewing head 40.

The controller then advances to step 207 where the total stitch count (N) is determined by controller 36 by adding each stitch count signal from stitch counter 90. Next, a determination is made at step 209 as to whether the total stitch count (N) is equal to the number of stitches to count before inserting the display ($N=n_s$). If true, the controller advances to step 211 where it commands the display inserter 64 to move the display feeder 65 into the sewing area as described above. The frictional interference between the collarette 22 and display 24 causes the display to be drawn under presser foot so to be sewn to the collarette 22 and the garment body 20. The controller then returns to step 207 to update the total stitch count as described above. If the total stitch count is not equal to the number of stitches to count before inserting the display, the controller advances to step 213.

At step 213, a determination is made as to whether the total stitch count (N) is equal to the number of stitches to count before inserting the label ($N=n_l$). If true, the controller advances to step 215 where the controller 36 activates the label feeder 70. At this time, the label feed arm 72 brings a pre-cut label 26 into the sewing area and positions same on top of the display 24 and under the sewing head 40. After the label has started to be sewn to the garment, label arm 72 returns to its vertical position to grab another label 26 with grippers 74 from hot wire knife 76. Label arm 72 then moves down to a position just above sewing head 40 to await the next label insertion command from controller 36. The controller then returns to step 207 to update the total stitch count as described above. If the total stitch count is not equal to the number of stitches to count before inserting on the label, the controller advances to step 217.

At step 217 a determination is made as to whether the total stitch count (N) is equal to the number of stitches to count to stop feeding the display material ($N=n_s+n_d$). If true, the controller advances to step 219 where it activates the display inserter 64 to move the display feeder away from the sewing area. A trimmer (not shown) attached to right side of sewing head 40 cuts the display material as the display feeder 65 moves away from the sewing area. The controller then returns to step 207 to update the total stitch count as described above. If the total stitch count is not equal to the number of stitches to count to remove the display, the controller advances to step 221.

At step 221 the controller checks whether the trailing edge sensor 84 has signalled a "no garment present". If true, after predetermined number of stitches, presser foot 80 is raised, and if the trailing edge sensor 84 still does not detect another garment body, sewing head 40 is turned off and the first sewing operation will have completed a full cycle. If the trailing edge of the garment is not detected, the controller returns to step 207 to update the total stitch count as described above.

As will become readily apparent to those skilled in the art, the display feeder and label feeder can be deactivated to vary the finished product. For example, the label feeder 70 can be deactivated so that when the apparatus is operated, only a collarette and display will be sewn to the garment body. Similarly, the display feeder can be deactivated such that only a collarette and label will be sewn to the garment body.

Additionally, as will become apparent to those skilled in the art, the synchronization of display and label feeding need not be dependant on stitch count. For example, timed synchronization can be used to command the display feeder and label feeder at the appropriate predetermined times.

Furthermore, as will become readily apparent to those skilled in the art, a second sewing operation on the garment can be performed to sew the loose end of the display down over the overedge seam 32 with a top stitch 33.

Alternate related embodiments for practicing the invention are disclosed in co-pending U.S. patent application U.S. Ser. No. 07/711,315, filed Jun. 6, 1991 for AN IMPROVED METHOD AND APPARATUS FOR AUTOMATICALLY ATTACHING A COLLARETTE, DISPLAY, AND LABEL TO A GARMENT BODY, commonly assigned to Union Special Corporation, the disclosure of which is hereby incorporated by reference.

Although illustrative preferred embodiments have thus been described herein in detail, it should be noted and will be appreciated by those skilled in the art that numerous variations may be made within the scope of this invention without departing from the principle of the invention and without sacrificing its advantages. The terms and expressions have been used as terms of description and not terms of limitation. There is no intention to use the terms or expressions to exclude any equivalents of features shown and described or portions thereof and the invention should be interpreted in accordance with the claims which follow.

We claim:

1. An apparatus for sewing a collarette and a label to a garment body comprising:

a sewing machine having a sewing head;

a collarette feed means for feeding collarette material under said sewing head and causing said collarette material to be sewn to said garment body;

a label feed means including means for cutting an individual label from a continuous supply of label material, said label feed means feeding said label under said sewing head on command and causing said label to be sewn to said garment body and said collarette material; and a controller means to command said label feed means.

2. An apparatus according to claim 1 further comprising a stitch count means for counting a total number of stitches performed by said sewing machine; and said controller means commanding said label feed means when the total number of stitches counted equals a predetermined value.

3. An apparatus according to claim 1 further comprising a timer means for counting a total elapsed time since commencing a sewing operation; and said controller means commanding said label feed means when the total elapsed time equals a predetermined value.

4. An apparatus for sewing a collarette, a display, and a label to a garment body comprising:

a sewing machine having a sewing head;

a collarette feed means for feeding collarette material under said sewing head and causing said collarette material to be sewn to said garment body;

a display feed means for feeding display material under said sewing head on command and causing said display material to be sewn to said garment body and said collarette material;

a label feed means including means for cutting an individual label from a continuous supply of label material, said label feed means feeding said label under said sewing head on command and causing said label to be sewn to said garment body, collarette material, and display material; and a controller means commanding said display feed means and said label feed means.

5. An apparatus according to claim 4 further comprising a stitch count means for counting a total number of stitches performed by said sewing machine;

said controller means commanding said display feed means when the total number of stitches counted equals a first predetermined value;

said controller means commanding said label feed means when the total number of stitches equals a second predetermined value; and said controller means commanding said display feed means to stop feeding display material when the total number of stitches counted equals a third predetermined value.

6. An apparatus according to claim 4 further comprising a timer means for counting a total elapsed time since commencing a sewing operation;

said controller means commanding said display feed means when the total elapsed time equals a first predetermined value;

said controller means commanding said label feed means when the total elapsed time equals a second predetermined value; and said controller means commanding said display feed means to stop feeding display material when the total elapsed time equals a third predetermined value.

7. An apparatus for sewing a collarette, a display, and a label to a garment body comprising:

a sewing machine having a sewing head;

a collarette feed means for feeding collarette material under said sewing head and causing said collarette material to be sewn to said garment body;

a display feed means for feeding display material under said sewing head on command and causing said display material to be sewn to said garment body and said collarette material;

a label feed means including means for cutting an individual label from a continuous supply of label material, said label feed means feeding said label under said sewing head on command and causing said label to be sewn to said garment body, collarette material, and display material;

a controller means commanding said display feeder and said label feeder;

a stitch counter for counting a total number of stitches performed by said sewing machine;

said controller commanding said display feeder to feed said display material under said sewing head when the total number of stitches is equal to a distance in stitch counts from an edge of said garment body to a starting display position;

said controller commanding said label feeder to feed a label under said sewing head when the total number of stitches is equal to a distance in stitch counts from said edge of said garment body to a starting label position; and said controller commanding said display feeder to stop feeding material under said sewing head when the total number of stitches is equal to a distance in stitch counts from said edge of said garment body to an ending display position.

8. A method for sewing a collarette and a label to a garment body comprising the steps of:

loading said garment body under a sewing machine sewing head;

feeding collarette material under said sewing head and causing said collarette material to be sewn to said garment body;

cutting a label from a continuous supply of label material; and feeding said label under said sewing head on command and causing said label to be sewn to said garment body and said collarette material.

9. A method according to claim 8 further comprising the steps of counting a total number of stitches performed by said sewing machine; and commanding label feeding when the total number of stitches performed equals a predetermined value.

10. A method according to claim 8 further comprising the steps of timing a total elapsed time since commencing a sewing operation; and commanding label feeding when the total elapsed time equals a predetermined value.

11. A method for sewing a collarette, a display and a label to a garment body comprising the steps of:

loading said garment body under a sewing machine sewing head;

feeding collarette material under said sewing head and causing said collarette material to be sewn to said garment body;

feeding display material under said sewing head on command and causing said display material to be sewn to said garment body and said collarette material;

cutting a label from a continuous supply of label material, and feeding said label under said sewing head on command and causing said label to be sewn to said garment body, collarette material, and display.

12. A method according to claim 11 further comprising the steps of counting a total number of stitches performed by said sewing machine;

commanding display feeding when the total number of stitches performed equals a first predetermined value; and commanding label feeding when the total number of stitches performed equals a second predetermined value.

13. A method according to claim 11 further comprising the steps of timing a total elapsed time since commencing a sewing operation;

commanding display feeding when the total elapsed time equals a first predetermined value; and commanding display feeding when the total elapsed time equals a second predetermined value.

14. A method for sewing a collarette, a display and a label to a garment body comprising the steps of:

loading said garment body under a sewing machine sewing head;

feeding collarette material under said sewing head and causing said collarette material to be sewn to said garment body;

feeding display material under said sewing head on command and causing said display material to be sewn to said garment body and said collarette material;

cutting a label from a continuous supply of label material;

feeding said label under said sewing head on command and causing said label to be sewn to said garment body, collarette material, and display material;

counting a total number of stitches performed by said sewing head;

commanding display feeding when the total number of stitches performed is equal to a distance in stitch counts from an edge of said garment body to a starting display position;

commanding label feeding when the total number of stitches is equal to a distance in stitch counts from said edge of said garment body to a starting label position; and commanding display feeding to stop feeding display material under said sewing head when the total number of stitches is equal to a distance in stitch counts from said edge of said garment body to an ending display position.

* * * * *